US011631553B2

(12) United States Patent
Postmus

(10) Patent No.: US 11,631,553 B2
(45) Date of Patent: Apr. 18, 2023

(54) OPERATING MECHANISM FOR OPENING AND CLOSING AT LEAST TWO CONTACTS SIMULTANEOUSLY

(71) Applicant: Eaton Intelligent Power Limited, Dublin (IE)

(72) Inventor: Albert Postmus, Goor (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/521,889

(22) Filed: Nov. 9, 2021

(65) Prior Publication Data

US 2022/0148824 A1 May 12, 2022

(30) Foreign Application Priority Data

Nov. 10, 2020 (GB) ..... 2017719

(51) Int. Cl.

| | |
|---|---|
| ***H01H 3/38*** | (2006.01) |
| ***H01H 3/42*** | (2006.01) |
| ***H01H 3/46*** | (2006.01) |
| ***H01H 33/02*** | (2006.01) |
| ***H01H 33/666*** | (2006.01) |

(52) U.S. Cl.

CPC ..... *H01H 3/46* (2013.01); *H01H 3/42* (2013.01); *H01H 33/022* (2013.01); *H01H 33/666* (2013.01); *H01H 3/38* (2013.01)

(58) Field of Classification Search

CPC .. H01H 3/46; H01H 3/42; H01H 3/38; H01H 33/022; H01H 33/666; H01H 33/42; H01H 2033/6667; H01H 9/24

USPC ..... 200/5 B, 5 C, 33 B, 416, 431, 432, 558, 200/568, 573, 324, 400

See application file for complete search history.

(56) References Cited

U.S. PATENT DOCUMENTS

| | | | | |
|---|---|---|---|---|
| 3,729,065 | A * | 4/1973 | Baskerville | H01H 3/30 200/558 |
| 4,163,133 | A * | 7/1979 | Bould | H01H 3/30 200/400 |
| 8,664,556 | B2 * | 3/2014 | Yamamoto | H01H 3/3031 200/469 |
| 9,373,456 | B2 * | 6/2016 | Yang | H01H 3/42 |

(Continued)

FOREIGN PATENT DOCUMENTS

| | | |
|---|---|---|
| CN | 201886920 U | 6/2011 |
| GB | 2557582 A | 6/2018 |
| WO | WO 2014198290 A1 | 12/2014 |

*Primary Examiner* — William A Bolton

(74) *Attorney, Agent, or Firm* — Leydig, Voit & Mayer, Ltd.

(57) ABSTRACT

An operating mechanism for opening and closing at least two contacts simultaneously is provided. The operating mechanism includes a base frame and a bridge body having an elongate contact surface with a length and a width. The elongate contact surface is configured to extend in a length direction over and be in contact with operating rods of the at least two contacts. The operating mechanism further includes a first reaction arm extending substantially parallel to the length of the elongate contact surface and a second reaction arm extending parallel to the first reaction arm and at a distance of the first reaction arm in the direction perpendicular to the elongate contact surface. The operating mechanism also includes a rod mechanism of two links and a cam arranged on a shaft.

6 Claims, 3 Drawing Sheets

(56) References Cited

U.S. PATENT DOCUMENTS

| | | | | |
|---|---|---|---|---|
| 9,704,661 | B2 * | 7/2017 | Chen | H01H 3/26 |
| 2019/0131090 | A1 * | 5/2019 | Dixit | H01H 9/26 |

* cited by examiner

OPERATING MECHANISM FOR OPENING AND CLOSING AT LEAST TWO CONTACTS SIMULTANEOUSLY

CROSS-REFERENCE TO PRIOR APPLICATION

Priority is claimed to British Patent Application No. GB 2017719.2, filed on Nov. 10, 2020, the entire disclosure of which is hereby incorporated by reference herein.

FIELD

The invention relates to an operating mechanism for opening and closing at least two contacts simultaneously.

BACKGROUND

In medium voltage switch gear it is required that typically three contacts for the three phases can be closed and opened simultaneously. The contacts are typically provided in the form of vacuum interrupters. The opening and closing speed of said vacuum interrupters must be within certain limits to operate on a high level of reliability.

An operating mechanism is known for opening and closing which has a base frame and a bridge body with an elongate contact surface, which is configured to extend in length direction over and be in contact with the operating rods of the contacts. A rod mechanism is provided for pushing the bridge body up and down and as a result opening and closing the contacts.

The rod mechanism is however complex using a plurality of links hinging together in order to achieve a reliable movement of the bridge body, such that the contacts are closed and opened simultaneously. However, the high complexity results in high production costs and increased chance on misalignment of the movement, as each part needs to be accurately made.

SUMMARY

In an embodiment, the present invention provides an operating mechanism for opening and closing at least two contacts simultaneously, wherein the operating mechanism comprises: a base frame; a bridge body having an elongate contact surface with a length and a width, wherein the elongate contact surface is configured to extend in length direction over and be in contact with operating rods of the at least two contacts; a first reaction arm extending substantially parallel to the length of the elongate contact surface, wherein the first reaction arm is hinging with one end to the base frame and with the other end to the bridge body; a second reaction arm extending parallel to the first reaction arm and at a distance of the first reaction arm in the direction perpendicular to the elongate contact surface, wherein the second reaction arm is hinging with one end to the base frame and with the other end to the bridge body; a rod mechanism of two links, wherein the first ends of the two links are hinging with each other, wherein the second end of one link is hinging with the base frame and the second end of the other link is hinging with the bridging body, wherein hinging axes of the rod mechanism are parallel to the width of the elongate contact surface; and a cam arranged on a shaft, wherein the shaft is arranged adjacent to the rod mechanism, wherein the shaft extends parallel to the hinging axes of the rod mechanism, and wherein the cam is in operating contact with the hinging axis of the first ends of the two links.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
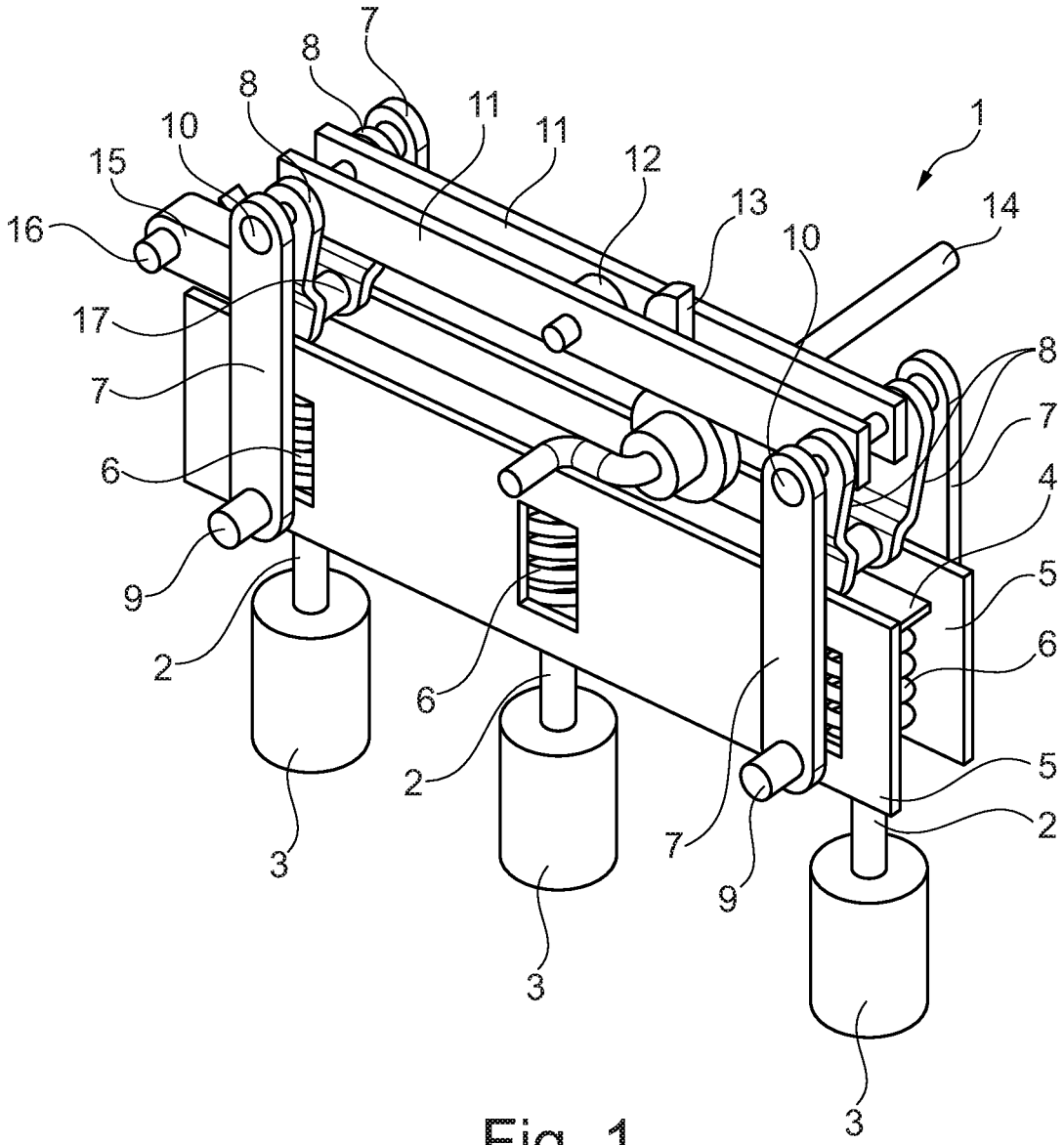
Fig. 1 PRIOR ART
FIG. 1 shows a perspective view of an operating mechanism according to the prior art.

An embodiment of the present invention reduces or even removes the above mentioned disadvantages.

In an embodiment, the present invention provides an operating mechanism for opening and closing at least two contacts simultaneously. The operating mechanism comprises: a base frame; a bridge body having an elongate contact surface with a length and a width, which elongate contact surface is configured to extend in length direction over and be in contact with the operating rods of the at least two contacts; a first reaction arm extending substantially parallel to the length of the elongate contact surface, wherein the first reaction arm is hinging with one end to the base frame and with the other end to the bridge body; a second reaction arm extending parallel to the first reaction arm and at a distance of the first reaction arm in the direction perpendicular to the elongate contact surface, which second reaction arm is hinging with one end to the base frame and with the other end to the bridge body; a rod mechanism of two links wherein the first ends of the two links are hinging with each other, wherein the second end of one link is hinging with the base frame and the second end of the other link is hinging with the bridging body, wherein the hinging axes of the rod mechanism are parallel to the width of the elongate contact surface; a cam arranged on a shaft, wherein the shaft is arranged adjacent to the rod mechanism, wherein the shaft extends parallel to the hinging axes of the rod mechanism and wherein the cam is in operating contact with the hinging axis of the first ends of the two links.

With the operating mechanism according to the invention the two reaction arms ensure the aligned movement of the bridge body relative to the operating rods of the at least two contacts. The rod mechanism using two links then translates the rotation of the cam on the shaft into an up and down movement of the bridge body and as a result an open and closing actions of the contacts.

The operating mechanism according to the invention thus includes four hinging links to operate a number of contacts reliably and simultaneously. Due to the low number of links and thus hinge points, the chance on variation in the behavior of the operating mechanism will be reduced. Also, the costs may be reduced.

In a preferred embodiment of the operating mechanism according to the invention a cam follower is arranged on the hinging axis of the first ends of the two links and the cam follower is in contact with the cam.

The cam follower reduces friction between the cam and the hinging axis between the two links, such that a smooth movement of the rod mechanism is obtained when the shaft with the cam is rotated.

Although hinges with two degrees of freedom could be used, it is preferred when the hinging axes of the first and second reaction arm are parallel to the width direction of the elongate contact surface.

The resulting hinges have a single degree of freedom, i.e. rotation around a hinge axis.

In a further preferred embodiment of the operating mechanism according to the invention the bridge body comprises an elongate top wall and two sidewalls each depending from a longitudinal edge of the elongate top wall, wherein the elongate contact surface is provided by the surface of the top wall from which the sidewalls depend.

The top wall and two depending side walls provide a profile with a U-shaped cross-section, which is strong, while low in weight and thus costs.

Preferably, the first reaction arm and the second reaction arm are arranged on opposite sides of the elongate top wall.

In a further preferred embodiment of the operating mechanism according to the invention a contact spring is provided for each of the at least two contacts, wherein the contact springs are positioned against the elongate contact surface and between the depending side walls, wherein the bridge body further comprises a lock plate arranged between the depending side walls and parallel and at a distance from the elongate top wall, such that the contact springs are enclosed by the bridge body.

The contact springs ensure that the operating rods of the contacts will be urged to the open position. By enclosing the contact springs in the bridge body using the lock plate, it is possible to provide the contact springs with a pretension, which will influence the opening speed when the shaft and cam are released.

FIG. 1 shows an operating mechanism 1 according to the prior art. The operating mechanism 1 can operate three operating rods 2 of vacuum interrupters 3. The operating mechanism 1 has a bridge body with a top wall 4 and two depending side walls 5 which envelope contact springs 6.

The operating mechanism 1 comprises four sets of two links 7, 8. The long links 7 are hinged to a frame on one end 9 and with the other end 10 hinged to the shorter link 8, which is also hinged to the side walls 5 of the bridge body. The other ends 10 are also connected to each other via crossbars 11 between which a cam follower 12 is provided, which is operated by the cam 13 on the shaft 14.

In order to maintain the combination of links 7, 8 and crossbars 11 in position a reaction arm 15 is provided, which is connected with the end 16 to the frame and the other end 17 to the bridge body.

Figure 2:
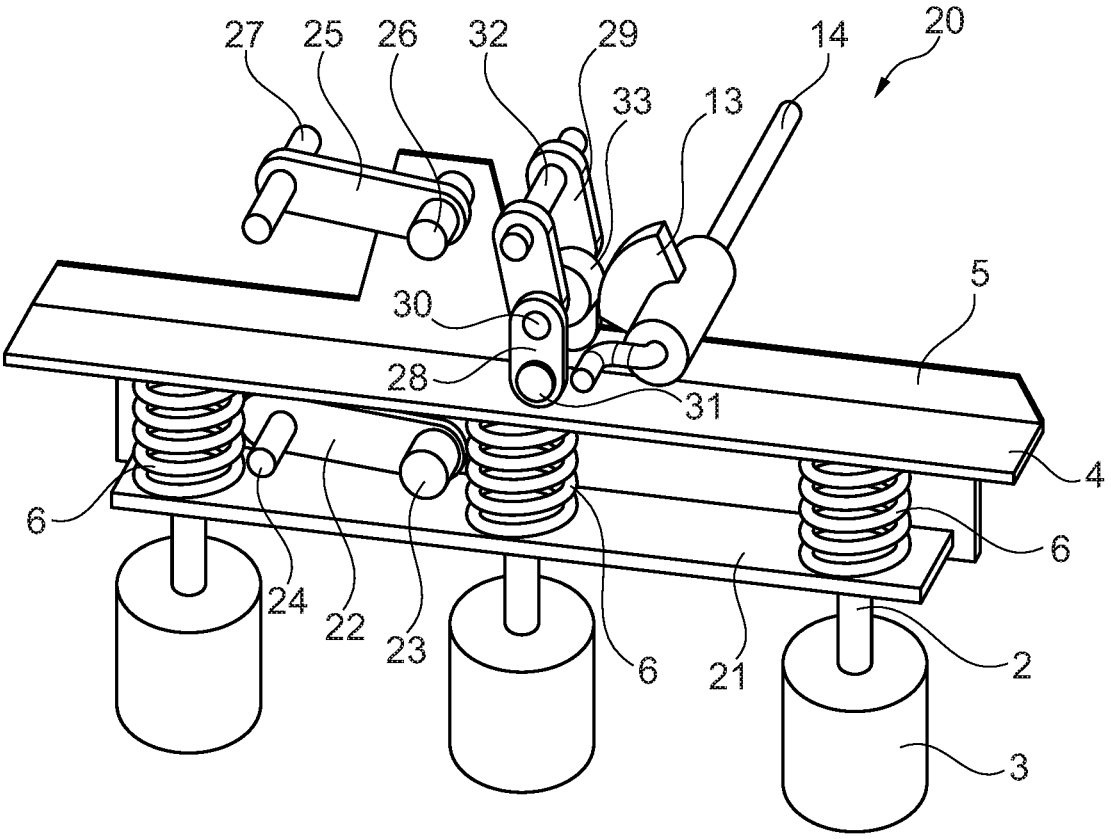
FIG. 2 shows a perspective view of an embodiment of an operating mechanism according to the invention.

FIG. 2 shows an embodiment of the operating mechanism 20 according to the invention. Parts corresponding to the embodiment of FIG. 1 are designated with the same reference signs.

The operating mechanism 20 also has a bridge body with a top wall 4, depending side walls 5 (one of which is shown) and a lock plate 21 in order to have the contact springs 6 enveloped by the bridge body and allowing the contact springs 6 to be pretensioned.

A first reaction arm 22 is provided hinged with one end 23 to the bridge body and with the other end 24 hinged to a base frame.

A second reaction arm 25 is provided parallel to the first reaction arm 22 and hinged with one end 26 to the bridge body and with the other end 27 hinged to the base frame.

The first reaction arm 22 and second reaction arm 25 ensure that the bridge body of top wall 4, depending side walls 5 and lock plate 21 can only move in the direction of the operating rods 2 of the vacuum interrupters 3.

The operating mechanism 20 further has a rod mechanism of two rods 28, 29, which hinge in the middle 30 with each other, on one end 31 hinge with the depending side walls 5 and with the other end 32 with the base frame.

At the middle hinge 30 a cam follower 33 is provided, which is in direct contact with the cam 13 arranged on the shaft 14.

Figure 3:
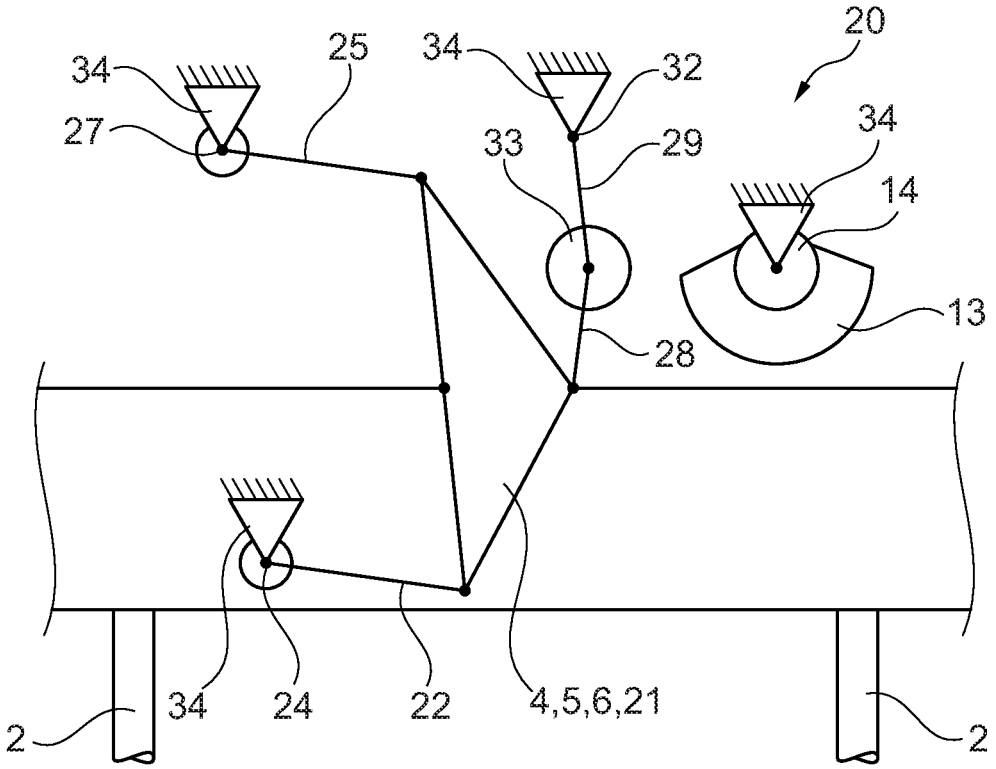
FIG. 3 shows a schematic diagram of the operating mechanism according to the invention.

FIG. 3 shows the operating mechanism 20 of FIG. 2 in a schematic way. From this schematic view, it can be seen that the first reaction arm 22 and second reaction arm 25 are hinged with their ends 24, 27 respectively to the base frame 34. Also, the other end 32 of the rod mechanism of two rods 28, 29 is hinged to the base frame 34, as well as the shaft 24.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An operating mechanism for opening and closing at least two contacts simultaneously, the operating mechanism comprising:

a base frame;

a bridge body having an elongate contact surface with a length and a width, wherein the elongate contact surface is configured to extend in a length direction over and be in contact with operating rods of the at least two contacts;

a first reaction arm extending substantially parallel to the length of the elongate contact surface, wherein the first reaction arm is hinging with one end to the base frame and with an other end to the bridge body;

a second reaction arm extending parallel to the first reaction arm and at a distance of the first reaction arm in a direction perpendicular to the elongate contact surface, wherein the second reaction arm is hinging with one end to the base frame and with an other end to the bridge body;

a rod mechanism of two links, wherein first ends of the two links are hinging with each other, wherein a second end of one link is hinging with the base frame and a second end of the other link is hinging with the bridging body, wherein hinging axes of the rod mechanism are parallel to the width of the elongate contact surface; and a cam arranged on a shaft, wherein the shaft is arranged adjacent to the rod mechanism, wherein the shaft extends parallel to the hinging axes of the rod mechanism, and wherein the cam is in operating contact with the hinging axis of the first ends of the two links.

2. The operating mechanism according to claim 1, wherein a cam follower is arranged on the hinging axis of the first ends of the two links and wherein the cam follower is in contact with the cam.

3. The operating mechanism according to claim 1, wherein the hinging axes of the first and second reaction arm are parallel to a direction of the width of the elongate contact surface.

4. The operating mechanism according to claim 1, wherein the bridge body comprises an elongate top wall and two sidewalls, each depending from a longitudinal edge of the elongate top wall, wherein the elongate contact surface is provided by a surface of the top wall from which the sidewalls depend.

5. The operating mechanism according to claim 4, wherein the first reaction arm and the second reaction arm are arranged on opposite sides of the elongate top wall.

6. The operating mechanism according to claim 4, wherein a contact spring is provided for each of the at least two contacts, wherein, for each of the at least two contacts, the contact spring is positioned against the elongate contact surface and between depending side walls, wherein the bridge body further comprises a lock plate arranged between the depending side walls and parallel and at a distance from the elongate top wall, such that the contact springs are enclosed by the bridge body.

* * * * *